United States Patent [19]

Finze

[11] 4,306,703

[45] Dec. 22, 1981

[54] INTERMEDIATE SUPPORT FOR AN OUTBOARD MOTOR

[76] Inventor: Fritz-Johann Finze, Stader Landstrasse 32, 2820 Bremen 77, Fed. Rep. of Germany

[21] Appl. No.: 3,529

[22] Filed: Jan. 15, 1979

[51] Int. Cl.[3] ..... F16M 1/00

[52] U.S. Cl. ..... 248/642; 440/900

[58] Field of Search ..... 248/283, 640, 641, 642, 248/643, 282; 115/17; 440/900

[56] References Cited

U.S. PATENT DOCUMENTS

| | | | |
|---|---|---|---|
| 1,007,590 | 10/1911 | Miller | 248/282 X |
| 2,740,602 | 4/1956 | Kloss . | |
| 2,808,218 | 10/1957 | Steller | 248/641 |
| 2,822,142 | 2/1958 | Collins | 248/641 |
| 2,928;630 | 3/1960 | Wisman | 440/900 X |
| 2,928,631 | 3/1960 | Hartman | 248/641 |
| 2,965,064 | 12/1960 | Wallace | 248/282 X |
| 3,242,899 | 3/1966 | Hanson | 248/641 X |
| 3,604,674 | 9/1971 | Wilkerson . | |
| 3,948,204 | 4/1976 | Brock . | |
| 3,968,768 | 7/1976 | Solt | 248/642 X |
| 4,013,249 | 3/1977 | Meyer | 248/642 |
| 4,168,818 | 9/1979 | Ellis | 248/640 |

FOREIGN PATENT DOCUMENTS

| | | | |
|---|---|---|---|
| 1278271 | 9/1968 | Fed. Rep. of Germany . | |
| 156990 | 11/1956 | Sweden | 248/642 |

*Primary Examiner*—J. Franklin Foss

*Attorney, Agent, or Firm*—Wood, Herron & Evans

[57] ABSTRACT

The invention relates to an intermediate support, intended in use to be fixed on the transom or stern of a boat and carries at its free end facing away from the transom a clamping board or plate, on which can be fixed a standard production outboard motor. The intermediate support is provided with a pivot bearing having a vertical or slightly inclined axis, so that the clamping board carrying the outboard motor can be swung to such an extent from a first position, in which the clamping board is disposed parallel to the transom of the boat, to a position in which it extends, for example, parallel to the length direction of the boat. As a supplementary feature, the clamping board of the intermediate support may be adjustable in height.

21 Claims, 12 Drawing Figures

INTERMEDIATE SUPPORT FOR AN OUTBOARD MOTOR

This invention relates to an intermediate support for an outboard motor, with a fixing means which can be fitted on the transom of a motor yacht, sailing yacht or the like and on which is arranged a connecting means which, spaced from the transom, carries a holding or clamping board to which can be clamped the outboard motor.

Practically all outboard motors which are produced in considerable numbers are equipped with motor supports, which belong to the standard supply of the outboard motors, comprise a clamping means for fixing the motors on the transom of the boat to be driven, are equipped with a pivot bearing which enable the motors to be swivelled about an axis perpendicular to the propeller shaft and hence the boat to be steered, and which generally also include a tilting means. The latter can be so secured by a latching mechanism that the pivot axis previously referred to extends vertically in the position for operating the motor, while the tilting axis is directed horizontally. If the underwater part of an outboard motor runs up against an obstruction in smooth water, the holding force of the latching mechanism is over come and the motor is then able automatically to hinge upwardly, so that any damage to the motor is avoided. The tilting means also serve to permit an outboard motor to be stored as far as possible completely out of the water, should it temporarily not be required for driving purposes, but is to remain fixed on the transom. In this rest position, a part of the outboard motor extends over the top edge of the transom into the boat and its shaft with the propeller extends a comparatively long distance sternwards beyond the contour of the boat.

With mass-produced outboard motors, the internal combustion engine is positioned above the clamping means. The internal combustion engine is connected to the screw or propeller through a so-called stock having a shaft extending therethrough. The motor support is usually also fixed on this stock. The clamping means thereof thus has a fixed spacing prescribed by the construction from the propeller shaft, which is to be immersed to a sufficient depth in the water in order to produce a good propulsion. The consequence is that the top edge of the transom, over which the clamping means engage, has to be comparatively low. As a result, particularly with the construction of relatively large boat hulls, attention has to be paid by constructive procedures to a sufficiently low position of the top edge of the transom.

As the size of the boat is increased, such a consideration becomes increasingly more difficult; in many cases, it is undesirable and frequently is is also impossible.

In order to avoid these problems, intermediate supports have been developed which are fixed on the transom and comprise a clamping board spaced from the transom. For the purposes of accomodating an outboard motor, the said clamping board replaces the transom and is located in spaced relation from the transom, so that the outboard motor is suspended by means of this clamping board and is capable of being fixed thereon by means of a clamping device. Since these intermediate supports with a fixed clamping board height do not in every case ensure a sufficient depth of immersion of the propeller, other intermediate supports have been developed, with which the clamping board is adjustable in height in relation to the fixing of the intermediate support on the transom, and thus in relation to the said transom. Serving in one case for the height adjustment of the clamping board is a parallelogram linkage, which forms the means of connection between the clamping board and the fixing of the intermediate support. In another case (YAMAHA brochure 1978; 9/77), the intermediate support comprises two rails, which are arranged extending vertically on the transom and form the fixing means. Running in these rails are two parallel supports, which carry the clamping board at their free ends.

Many types of outboard motors are available which have two different stock or trunk lengths. It is accordingly possible for the problems which arise and which have already been discussed to be obviated in connection with one of the intermediate supports already referred to.

The extent of the projection of outboard motors tilted upwardly in their rest position sternwardly beyond the stern is already troublesome when the motors are directly secured on the transom. With a relatively heavy seaway, with manoevres for coming alongside and at the berthing position, the outboard motors are seriously exposed and may easily be damaged. This danger is obvious, having regard to the comparatively long lever arms. Consequently, when sailing, an outboard motor is often taken into the boat, so as to avoid any damage in a heavy sea. It is certainly protected in this position, but in an emergency, it is only possible for it to be again brought into its operative position with loss of time and with difficulty, and while increasing the danger. These difficulties are necessarily increased by each of the known intermediate supports, because the amount of the projection of an outboard motor tilted upwardly into a rest position is increased by the distance which the clamping board has to have from the transom.

Accordingly, the invention seeks to develop an intermediate support of the type as initially referred to, so that an outboard motor secured on it, using its mass-produced motor support, is capable of being moved easily and safely, even in bad weather, and is better protected than hitherto in its rest position against any damage.

According to the invention the intermediate support has at least one pivot bearing with a pivot shaft extending in a vertical plane being arranged in the region of the connection means, about which shaft the clamping board is movable between an operating position of the motor parallel to the transom and at least one lateral rest position and is capable of being fixed in each of these positions by at least one latching mechanism.

I have found that by using an intermediate support as so developed, the difficulties caused by the projection of the outboard motor are eliminated, because the point of application of external forces on the outboard motor becomes set back by a considerable amount in the direction towards the transom. In addition, the size of the berth for a boat which is equipped in this way is reduced. Finally, it is quite important that also the handling is more reliable, because the outboard motor, already before it is tilted upwardly into its rest position, is folded on to the boat about the pivot shaft of the intermediate support and, on being brought into operation, can be tilted back in this folded position into its operative position.

Advantageous developments of intermediate supports of this type with fixed clamping boards and, especially with clamping boards which can be adjusted in height are described hereinafter.

The invention is hereinafter described by way of example and by reference to a number of embodiments and by reference to drawings, wherein FIG. 1 is a side elevation of a first constructional example of an intermediate support mounted on the stern of a sailing yacht; with an upwardly hinged outboard motor;

FIGS. 2 and 3 each represent a separate view of the intermediate support of FIG. 1, respectively seen in the directions II and III;

Figure 1:
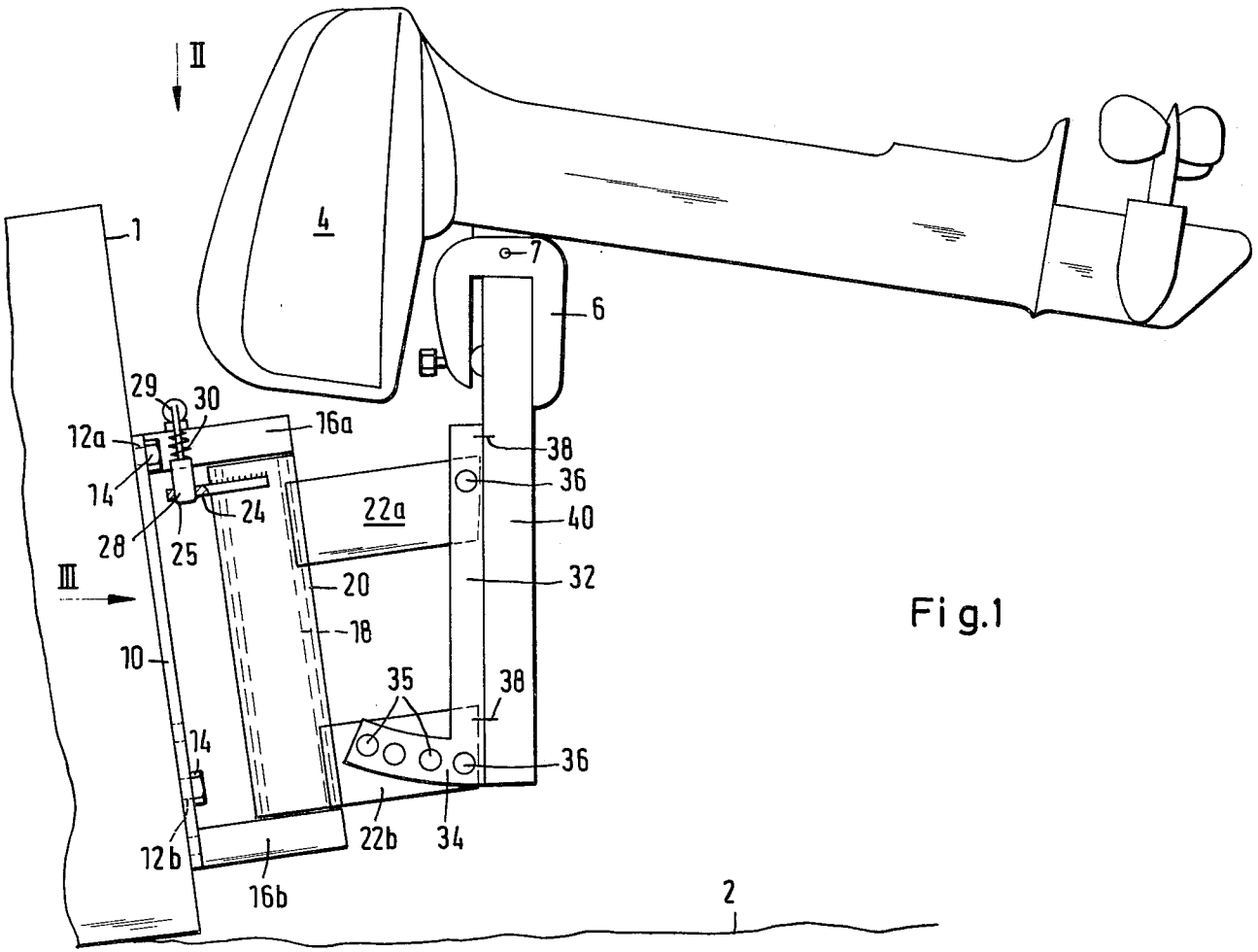

The first constructional example of an intermediate support, as represented in FIGS. 1, 2, 3 and 7, serves for the permanent fitting of an outboard motor 4 on the transom 1, for example, of a sailing yacht. The intermediate support is connected by means of a fixing plate 10 and screw-bolts 14 so as to be fast with the transom 1, while the outboard motor 4 has in the usual manner a clamping claw 6 fixed by a rocker bearing 7 on the shaft stock or housing, the said claw being tightly screw-threaded on a clamping board 40 of the intermediate support. The outboard motor 4 is shown latched in its tilted position in FIG. 1.

All intermediate supports which are described herein have on their clamping board 40 a compensating stirrup or frame 32, which is swivellable relatively to the remainder of the intermediate support and is capable of being fixed in the required swivelled position, so that the clamping board 40 is always disposed in its optimal position, with each given slope of the boat transom. In FIG. 1, the transom 1 of the sailing yacht slopes forwardly and upwardly, corresponding to the present trend.

Formed in the fixing plate 10 at its upper end are two holes 12*a*, while the bottom end has altogether six holes 12*b*, for receiving the screwbolts 14. Depending on the structural features of the boat, screws 14 are only introduced into two of the said lower holes. Perpendicularly to the main plane of the fixing plate 10 and at its top and bottom ends are respectively welded an upper bearer 16*a* and a lower bearer 16*b*. Welded between those facing sides of the said bearers 16*a* and 16*b* is an internal tube 18 serving as pivot bearing for that movable part of the intermediate support which is to be later described, and the said tube has rotatably mounted thereon an external tube 20, by which the internal tube 18 is completely enclosed. Fixed on the external tube 20 is an upper arm 22*a* and a somewhat shorter arm 22*b*. With the constructional example as illustrated, the bearers 16 and the arms 22 are produced from square tubular material, but they can also consist of reinforced flat material. Instead of two arms 22, it is also possible to provide a U-shaped sheet metal part, which cooperates with the compensating stirrup 32, which then is possibly also U-shaped.

Provided at the ends of the arms 22*a* and 22*b* is on each a transverse bore for receiving two bolts 36, by which the compensating stirrup 32 which has already been mentioned and which carries the clamping board 40 is arranged to be adjustable. The compensating stirrup 32 has at its bottom end an L-shaped leg 34 with several holes 35. According to the slope of the transom of the sailing yacht, the hole 35 which is chosen for the bottom screwbolt 36 is that which imparts the required optimal position to the clamping board 40.

The clamping board 40 has several vertical pairs of holes 42, so that the said board 40 may at will be connected either symmetrically (FIG. 2) or to one side (FIG. 7) by screwbolts 38 to the compensating stirrup 32. The reasons for choosing an asymmetrical connection in accordance with FIG. 7 are hereinafter to be more fully discussed.

With all intermediate supports as described herein, it is possible, by using the internal tube 18 as a pivot pin, for the clamping board 40 to be swung from the operating position as shown in FIGS. 1, 2, 3 or 4 and at will towards the right or towards the left into a rest position on the transom 1 of the sailing yacht. In this rest position, the outboard motor 4 only projects slightly beyond the normal contour line of the sailing yacht and as a consequence is well protected and occupies little space, which provides advantages, more especially where restricted berthing conditions apply. The swivellable part of the intermediate support, consisting of the external tube 20, the arms 22, the compensating stirrup 32 and the clamping board 40, as well as the outboard motor, can at any time be arrested in the middle operative position and in the two lateral rest positions. Welded for this purpose on the external tube 20 is a semi-circular segment 24, the positions at which the movement may be arrested being defined by three holes in its circumference. A locking bolt 28 displaceably mounted in the upper bearer 16*a* engages with a knob 29 in the hole 25 corresponding to the selected position of the clamping board, the said knob being pre-tensioned by a spring in the arresting or locking position.

Should it be desired, when at sea, that the swivelled outboard motor 4 latched in its tilted position should be made clear for operational purposes, then it is only necessary to pull on the knob 29 of the locking bolt 28, to swing the motor into the operative position and to allow the locking bolt 28 to engage in the central hole 25. The outboard motor 4 is then tilted about its own rocker bearing 7 into its operative position, in which the screw or propeller dips into the water surface 2. These operations are capable of being easily carried out by one man, even when the sea is rough. The outboard motor can be rendered inoperative in the reverse direction in just as simple a manner.

Figure 7:
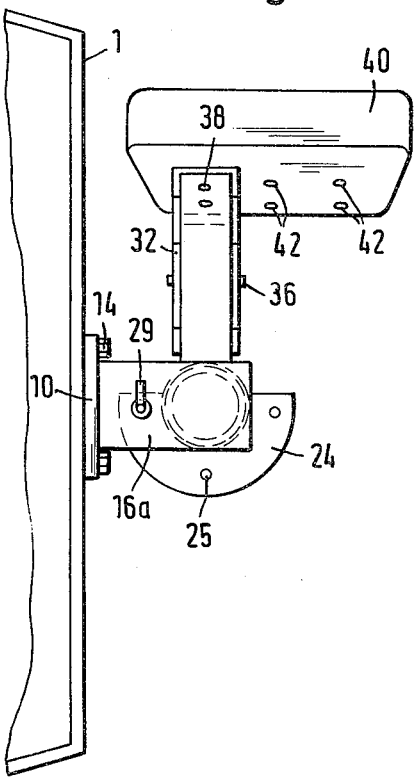
FIG. 7 is a view, similar to FIG. 2, of the first constructional example, but with a clamping board which is swivelled and screwed on asymmetrically.
Figure 3:
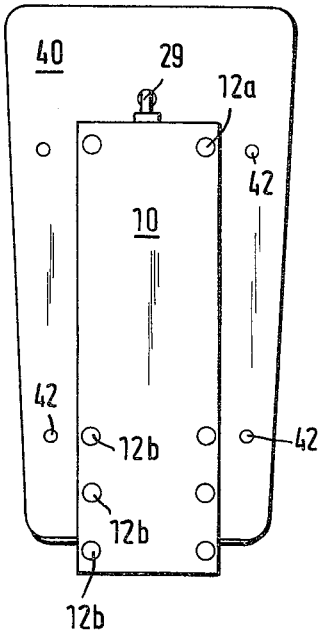
Figure 2:
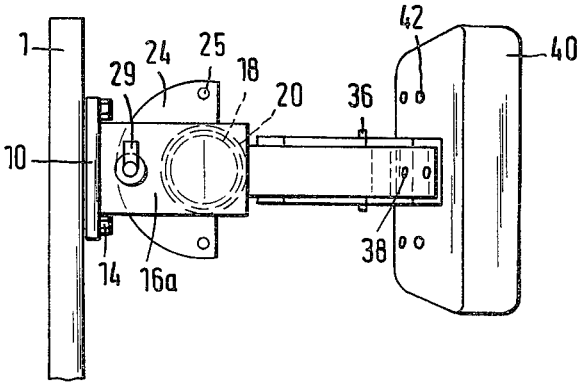

Many sailing yachts have a particularly broad transom 1, see FIG. 7, and/or the head of many motors is particularly voluminous. It is in these circumstances that the asymmetrical fixing of the clamping board 40 is recommended, as a result of which may contract between head and transom in the swivelled rest position of the motor is avoided. In this case, only the one rest position of the segment 24 is used.

Figure 4:
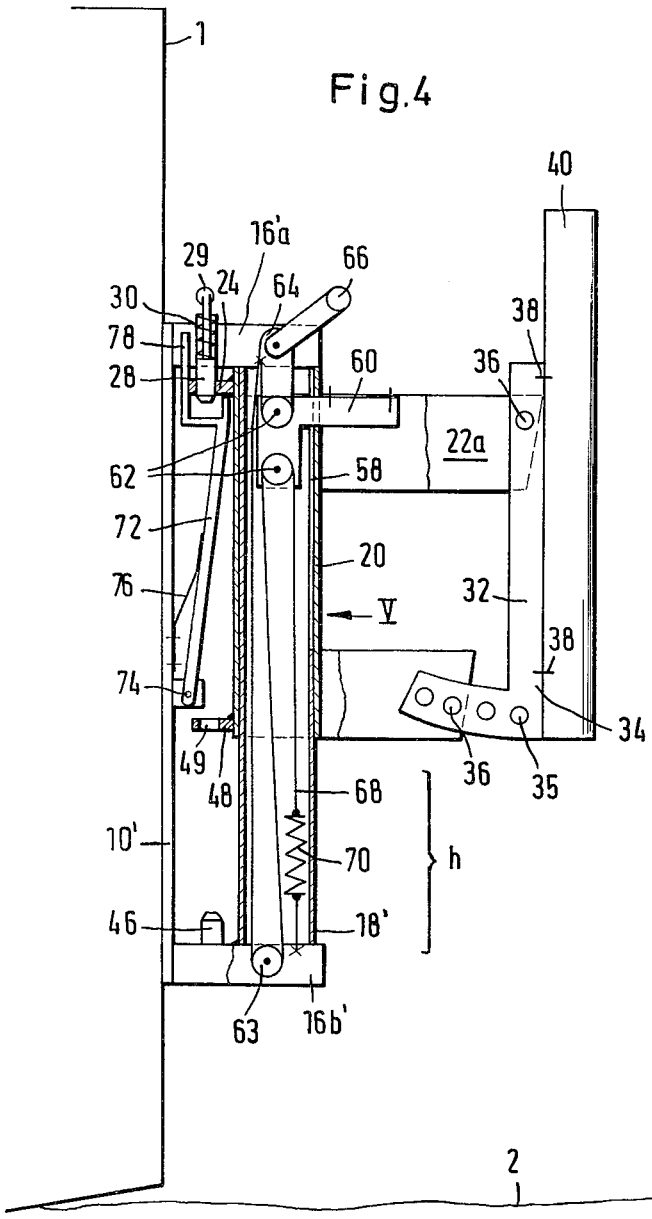
FIG. 4 is a view similar to FIG. 1, showing a second constructional example of an intermediate support.
Figure 6:
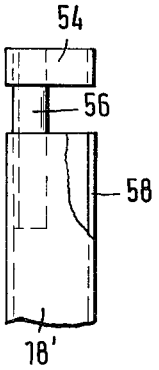
FIG. 6 is a side elevation, partly broken away, of the internal tube of FIGS. 4 and 5.
Figure 5:
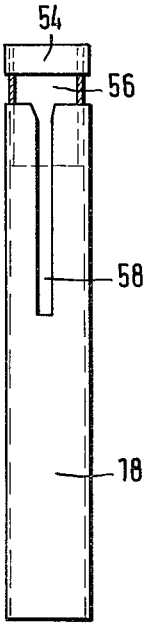
FIG. 5 is a separate view of an internal tube of the intermediate support, seen from the direction V of FIG. 4.
Figure 8:
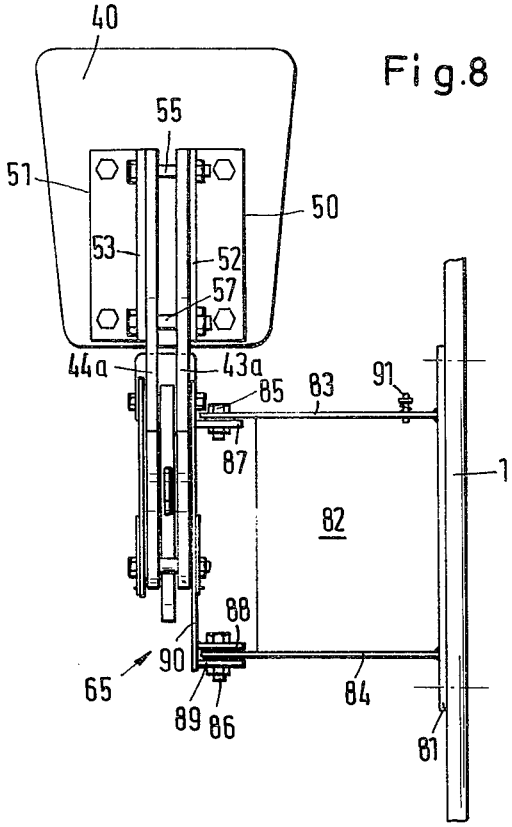
FIG. 8 is a side elevation of another constructional form of an intermediate support with a clamping board swivelled and raised about the pivot axis into the rest position.
Figure 9:
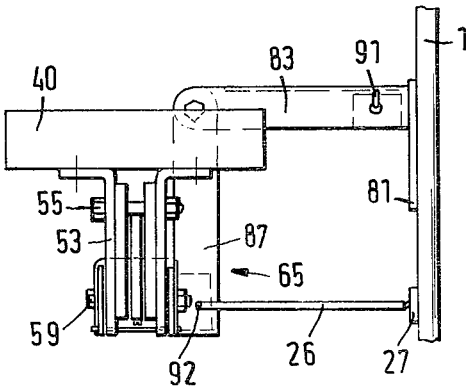
FIG. 9 is a plan view of the arrangement according to FIG. 8.

With the second constructional example of an intermediate support as shown in FIGS. 4 to 6, similar details are represented by the same references as those employed in the preceding constructional example, and references for similar details bear an apostrophe. The constructional example of FIG. 4 differs essentially from that which has been previously described by the fact that its clamping board 40 is not only capable of swivelling about the internal tube bearing the reference 18', but of being lifted and lowered vertically relatively to the water surface 2, so that it is possible to dispense with long-housing motors, which otherwise are frequently necessary, and the available short-housing motor can also be used for propelling a dinghy.

As with the previous constructional example, the slope or inclination of the transom 1 of the sailing yacht is compensated for by suitable choice of the bottom hole 35 for the bottom screwbolt 36. The lateral rest positions and the central operative position for the clamping board 40 with motor are here also once again determined by the locking bolt 28 with the knob 29 and the segment 24 which is fixed on the external tube 20 having the peripheral holes 25.

The essential differences of the constructional example as shown in FIGS. 4 to 6 consist in the lifting mechanism for the external tube 20 bearing the clamping board 40, The possible stroke or travel of the clamping board 40, as represented by h in FIG. 4, is defined by the difference in lengths between internal tube 18' and external tube 20 and can have practically any desired value. In FIG. 4, the clamping board 40 and the external tube 20 assume their upper end travel position, and this is fixed by a supporting lever 72 which engages beneath the segment 24 and of which its bottom end is rotatably mounted on a bearing block 74 arranged on the fixing plate 10'. The supporting lever 72 is capable of being moved out of the supporting position shown in FIG. 4 by a manual pulling action on an upper grip member and against the force of a leaf spring 76, in order to release the segment before the lowering of the clamping board.

The lifting mechanism for the external tube 20 with the clamping board 40 is situated between the bearers **16*a'* and 16*b'* and also inside the internal tube 18'. Initially forming part of the lifting mechanism is a guiding angle member 60 projecting into the interior of the internal tube 18' and fixed in the upper arm 22*a*, the free part of said member 60, in the raised position of the clamping board as shown in FIG. 4, being swivellable towards the right or left in a cut-out of the internal tube 18', in order to make possible the swinging of the clamping board on to the transom 1. According to FIGS. 5 and 6, this cut-out in the upper part of the internal tube 18' is formed by a semi-tubular neck section 56, which is fixed inside the internal tube 18' and carries a reinforcing head ring 54 at a distance above the upper end of the said tube 18'. It is intended that the lowering of the external tube 20 with clamping board 40 is only to be possible when the latter is in the position for operation of the motor; for this purpose, that side of the internal tube 18' which is to the rear in the operating position is formed with a vertical longitudinal slot 58**, the length of which approximately corresponds to the stroke or travel h.

Used as lifting mechanism in the constructional form of FIG. 4 is a crank drive with a tackle. Included herein are a winch roller 64 with laterally extending crank 66 and mounted in the upper bearer **16*a'*, a free roller 63 mounted in the lower bearer 16*b'*, two free rollers 62 mounted one above the other on the guiding angle member 60, a rope or cable 68 wrapping several times around the free rollers, each by about 180°, and the winch roller 64 and a tension spring 70 tightening the cable. By appropriate addition of other free rollers and/or by suitable choice of the diameter of the winch roller, it is possible, in the manner of a block and tackle arrangement, to adapt the transmission of the lifting mechanism to the forces which have to be overcome, i.e. more especially the weight of the motor. Serving for the stabilisation of the operating position of the clamping board when it is lowered, i.e. in the actual operating position of the motor, is a strap 48 which is welded to the bottom end of the external tube 20 and which has a hole 49, which is engaged, in the lowered position, by a pin 46 which is fixed on the lower bearer 16*b'***.

As an alternative to the embodiment which is shown in FIG. 4, the lifting mechanism may also consist of a tackle arrangement which is, for example, operative on the guiding angle member 60 and of which the loose end is guided into the cockpit of the sailing yacht. A winch for the tackle can be fixed in the cockpit if necessary. Such a lifting mechanism is shown in association with the constructional example according to FIG. 12.

Figure 12:
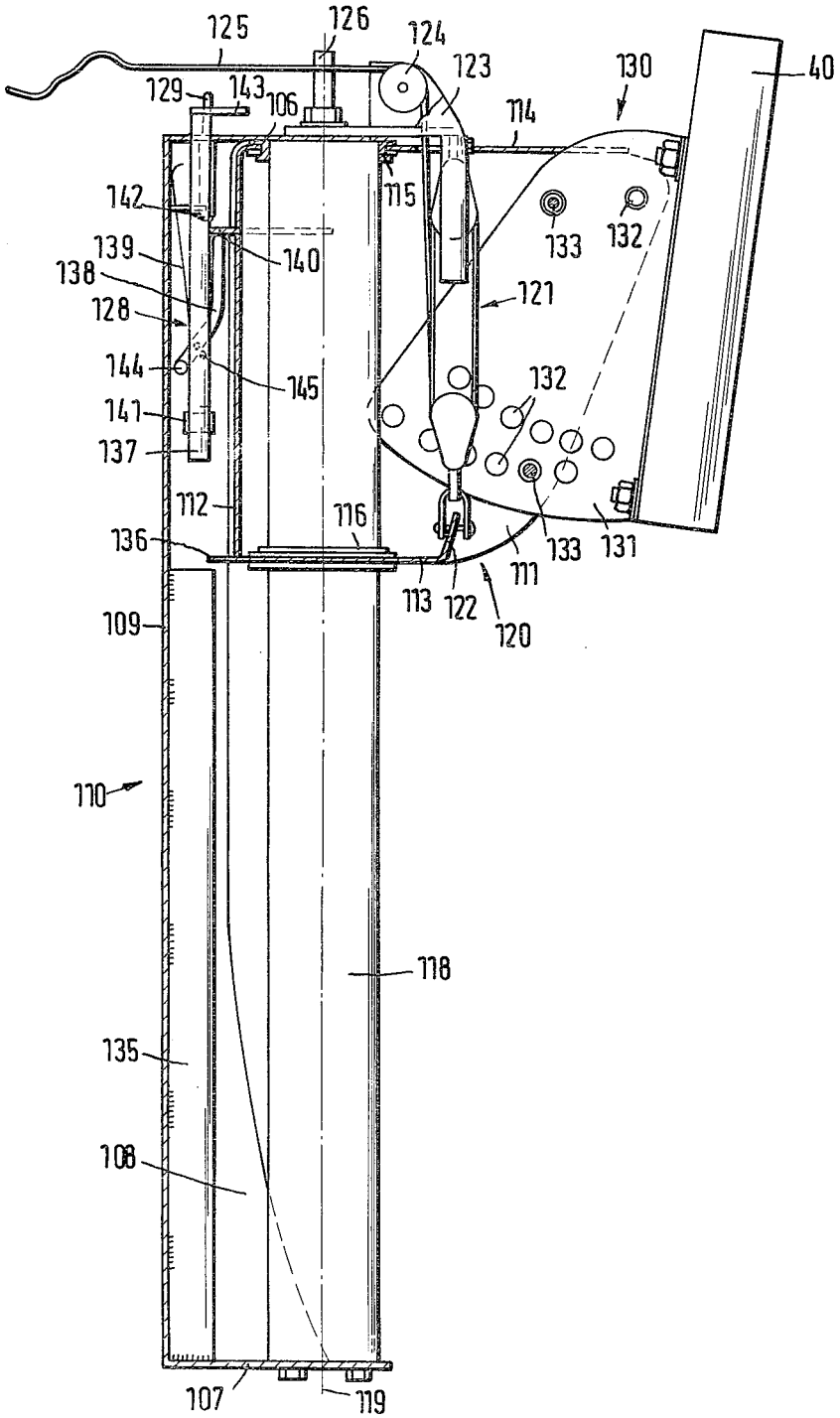
FIG. 12 is a partially sectioned side elevation of a constructional example which is similar to that of FIG. 4.

The intermediate support according to FIG. 12 comprises a box-shaped fixing means which is open on one side and has a rear wall 109, two side walls 108, of which only one can be seen in the drawing, a base plate 107 and a top plate 106. Fixed so as to be incapable of turning between the top plate 106 and the base plate 107 is an internal tube 118, the axis of which forms the pivot axis 119 of the intermediate support.

Instead of the external tube 20 of the constructional form as illustrated in FIG. 4, the preferred embodiment in accordance with FIG. 12 comprises a clamping board bearer 120 pivotally mounted on the internal tube 118. This is once again made in the form of a box and comprises two side walls 111 (of which once again only can be seen), a rear wall 112 of semicircular curvature connecting the side walls, a base plate 113 and also a top plate 114. Fitted into the top plate 114 is a bearing 115, while the bottom plate 113 has a bearing 116 fitted therein. These bearings comprise the internal tube 118, so that the clamping board bearer 120 can be twisted on the said tube about the pivot shaft 119.

The clamping board 40 has a screw-threaded connection with a receiver or holder 130, which comprises two apertured plates 131, which stand to the rear and perpendicularly of the clamping board and of which, once again, only one can be seen in the Figure. A number of holes 132 are formed at corresponding positions in the two plates 131. Always two of these holes have bolts 133 extending therethrough, the said bolts also being guided through two holes of the side walls 111 of the clamping board bearer 120. By means of the bolts 133 and by suitable choice of the holes 132 being used at any time, it is possible to adjust the slope of the clamping board in relation to the pivot axis or shaft 119. This possibility is desirable, so as to be able to fix the complete intermediate support to boats having transoms with a different slope or inclination and, at the same time, to ensure that the clamping board 40 is disposed either in a vertical plane or is even at such an inclination that, with the assistance of usual possibility of adjustment of mass-produced motor supports, at least the axis of the stem or housing of the outboard motor is perpendicular when in the operating position.

With the assistance of a latching mechanism 128 which is hereinafter to be more fully described, the fixing means 110 and the clamping board bearer 120 can be releasably coupled to one another, so that the fixing means 110 and the said bearer 120 maintain a mutual position for the running of the outboard motor beyond that which is shown in FIG. 12. The swivelling movement which is required about the pivot axis 119 is only possible after the latching mechanism 128 has been actuated.

If it is visualised that the base plate 107 of the fixing means 110 (contrary to what is shown in FIG. 12) is able to extend directly beneath the bottom bearing 116 of the clamping board bearer 120, then the previously described constructional form of FIG. 12 corresponds, in principle, to the constructional example of FIG. 1. Such an intermediate support is already very suitable for a large number of cases which occur in use, with which a height adjustment of the clamping board is not important.

On the other hand, if it is desired to have a height adjustment of the clamping board 40, it is merely necessary for the internal tube 118 to be given a greater length, corresponding to FIG. 12, and for the base plate 107 to have a corresponding spacing from the top plate 106. Not only is it then possible for the clamping board bearer 120 to be swivelled about the internal tube 118, but also for it to be moved up and down along the internal tube. Once again a tackle arrangement 121 is used for facilitating this up and down movement, the said arrangement 121 being fixed at one end on the clamping board bearer 120 at 122 and at the other end on a stand 123. The latter is capable of twisting in a horizontal plane about the axis 119, but otherwise is arranged to be immovable relatively to the internal tube 118 and the fixing means 110, respectively. It carries a deflecting pulley 124, which is rotatable about a horizontal axis and deflects the loose cable or rope end 125 of the tackle 121 in the direction towards the rear wall 109—and thus in the direction towards the cockpit of the boat. By means of a guide device 126, against which the rope end 125 is capable of bearing, when the clamping board bearer 120 is swivelled relatively to the fixing means, the result is achieved that the direction of pull on the rope end 125 remains substantially independent of the swivelled position which is assumed by the clamping board bearer 120 in relation to the fixing means 110. The rope end 125 can, for example, be fixed in the cockpit of the boat and possibly can be guided in the said cockpit over a winch, so that a normally comparatively heavy outboard motor fixed on the clamping board 40 can not only be conveniently lowered, but especially also with complete safety, from the cockpit, but can also be lifted out of the water.

In order to achieve the effect that the clamping board bearer 120 is only able to rotate about the pivot shaft 119 in the raised position, as illustrated, but is unable to rotate in relation to the internal tube 118 in each lowered position, the rear wall 109 of the fixing means 110 has arranged thereon a long piece of flat material 135 which is fixed on the said wall and projects in the direction towards the internal tube 118, the said material abutting at the bottom end against the base plate 107, while its upper end extends to just below the base plate 113 in its position as shown. The base plate 113 has a projection 136 projecting beyond the contour of the rear wall 112 and in the direction of the rear wall 109. This projection 136 extends beyond the free vertical edge of the flat material 135 and has a vertically extending slot which cannot be seen in the drawing and which extends from the free end of the projection 136 on the left-hand side and into the latter. Without the said slot, the projection 136, with the lowering of the clamping board bearer 120, would rest on the free upper edge of the flat material 135 and prevent a further downward movement. Actually, however, because of the said slot, the said bearer can readily be lowered. The slot embrace a part of the flat material 135. At the same time, by this construction and the coaction between the flat material, slot and projection 136, the clamping board bearer 120 is prevented from being rocked into a partially or completely lowered position.

The latching mechanism 128 consists of two structural groups for two different purposes. Common to both the said groups is a flange 140, which advantageously corresponds in its arrangement and design to the element 24 according to FIGS. 2 and 7 and is formed with holes 25, which cannot be seen in FIG. 12. This flange 140 is a fixed constituent of the clamping board bearer 120. A locking bolt 142 resiliently pre-tensioned in the locking position is able to engage in the said holes of the flange 140. The said bolt 142 is capable of actuation by means of a knob or lever 129. The structural group as thus far described serves for preventing an involuntary swivelling of the clamping board bearer 120.

The second structural group of the latching mechanism 128 comprises a pulling lever 137, which is guided for longitudinal displacement in the region of its lower end in a bearing 141 and in the region of its upper end in an opening of the cover plate 106, and comprises a handle 143 above the cover plate 106. Mounted to be rotatable about a horizontal shaft 144 is a locking bracket 138, the upper free end of which engages beneath the flange 140 when the clamping board bearer 120 is disposed in the raised position which is shown in FIG. 12. The locking bracket 138 is biassed or pre-tensioned by a leaf spring 139 into the locking position as shown, in which the said board bearer cannot be lowered. Provided on the pulling lever 137 is a driver member 145, which engages under a sloping section of the locking bracket 138 and, when the lever 137 is pulled upwardly, swings the locking bracket 138 in a counterclockwise direction and against the force of the leaf spring 139 out of the range of the flange 140. After this outward swinging movement, the clamping board bearer 120 can be moved downwardly along the internal tube 118. When the said bearer is subsequently raised again, the flange 140 automatically forces the locking bracket 138 out of the way. Under the action of the leaf spring 139, the locking bracket 138 again snaps into the locking position which is shown, as soon as the flange 140 has once again assumed its position as shown.

In the constructional form of an intermediate support as shown in FIGS. 8 to 11, the clamping board 40 is fixed through a parallelogram linkage 43*a, b,* 44*a, b* on the pivot bearing. Serving for the fixing on the clamping board 40 are adjustment angle brackets 50, 51, which are screwed at one side on the clamping board 40 and of which the sides 52, 53 projecting away from the said board 40 are formed with a row of holes 47 respectively facing one another. These holes in the side plates 52, 53 serve in pairs for the connection of the clamping board 40 to the parallelogram linkage. Serving for the connection are an upper bearing bolt 55 and a lower bearing bolt 57. The outer ends of the elements 43*a, b* and 44*a, b* of the parallelogram linkage are disposed in the intermediate space between the side plates 52, 53 and the bearing bolts 55, 57 extend through them.

The other ends of those elements of the parallelogram linkage which are parallel to one another are mounted for turning movement on bearing bolts 59, 61, which are in their turn fixed one above the other in a holder 65, which is U-shaped in plan view. Arranged on the holder are springs 67, 69, which engage beneath the elements of the parallelogram linkage and resiliently pre-tension them in an upward direction. A part of the weight of an outboard motor, which is not shown in FIGS. 8 to 11, is compensated for by the springs.

A bearing block 80, consisting essentially of a fixing plate 81, a side plate 82, an upper supporting arm 83 and a lower supporting arm 84, is fixed by means of screw-bolts (not shown) on the transom 1 of a boat. The supporting arms 83, 84 are arranged on the top and bottom ends, respectively, of the side plates 82 and project by a certain amount beyond the side plate in the direction of the clamping board 40. The side plate 82 and supporting arms 83, 84 extend in the operative position of the intermediate support parallel to and laterally alongside the parallelogram linkage 43*a, b,* 44*a, b.* Fitted in the region of the outer ends of the supporting arms 83, 84 are bearing bolts 85, 86, the axes of which extend vertically in the example represented and jointly define the pivot axis of the intermediate support.

The holder 65 is arranged on the bearing block 80, being rotatable about the pivot axis or shaft and being held by the bearing bolts 85, 86. For this purpose, the holder 65 has an upper arm 87 and one or two lower arms 88, 89, which are arranged projecting laterally on a plate 90 of the holder 65 and, in the operative position of the intermediate support (for example, FIG. 7), extend parallel to the supporting arms 83, 84 of the block 80 and have the bearing bolts 85, 86 extending through their free ends.

A latching mechanism is provided for ensuring the relative position of the bearing block 80 and holder 65 in the operative position of the intermediate support. In the constructional example as shown, this latching mechanism consists of a latch head 91, which is arranged on the upper supporting arm 83 of the bearing block, comprises a pin which passes through the supporting arm and is biased downwardly by means of a spring. Formed in the arm 87 of the holder 65 is a latch hole 92, in which the pin of the latch knob 91 engages under the pre-tension of the spring when the intermediate support is located in its operative position. For swinging the holder 65 relatively to the bearing block and thus also the clamping board or plate 40 relatively to the transom 1, it is consequently only necessary for the latch knob 91 to be pulled up against the spring force, whereupon the clamping board 40 can be swung in the required manner. For arresting the intermediate support in its rest position according to FIG. 9, it is possible to use a rod 26, of which the end on the transom side is fixed so as to be movable about a horizontal axis in a bearing block 27 fixed on the transom 1, and of which the other end is bent over and can be suspended in the latch hole 92 of the upper arm 87 of the holder 65.

Figure 10:
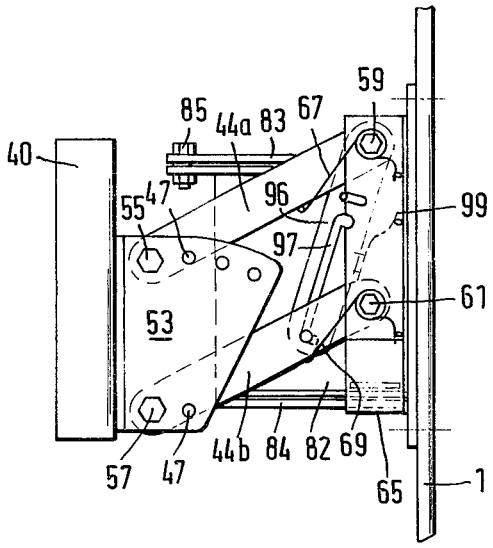
FIG. 10 is a side elevation of the constructional form according to FIG. 8; with a clamping board disposed in the operative position.
Figure 11:
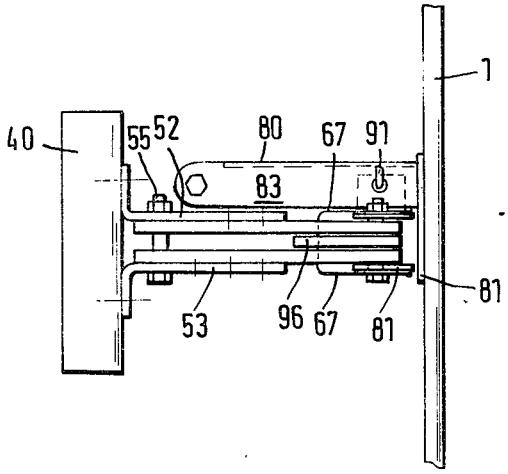
FIG. 11 is a plan view of the arrangement according to FIG. 10.

For arresting the clamping board or plate 40 in the lowered position according to FIG. 10 or in the raised position according to FIG. 5, a locking lever 96 is provided, which is mounted at its one end for swivelling movement on the bearing or mounting bolt 59 and has a longitudinal slot 97. The two ends of the longitudinal slot 97 are bent over at right-angles to the longitudinal axis of the locking lever 96. The two lower elements 43*b,* 44*b* of the parallelogram linkage are connected by a fixed pin 98, which extends parallel to the four mounting bolts (e.g. 61) of the parallelogram linkage and engages in the longitudinal slot 97. The locking lever 96 is biased in a counter-clockwise direction by means of a spring 99. The result obtained in this way is that the pin 98, in the two end positions of the parallelogram linkage, always remains safely in one of the two bent-out ends of the slot 97 and in this way effectively prevents a raising or lowering of the clamping plate 40 until the locking lever 96 is manually swivelled against the force of the spring 99 to such an amount that the pin 98 is able to make a movement through the slot 97.

In order to ensure that the stock (not shown) of the outboard motor is always disposed substantially vertically in its operating position, a possibility of adjustment of the clamping plate 40 is provided on the intermediate support. The aforementioned holes 47 in the side plates 52, 53 of the bracket member serve for the adjustment. According to the amount of the slope of the transom 1, the mounting bolts 55, 57 of the parallelogram linkage are guided through those holes 47 which make possible a vertical position of the clamping board 40. A supplementary possibility of adjustment is in addition provided in each mass-production motor mounting of outboard motors.

In the constructional example of FIGS. 8 to 11, the pivot shaft of the intermediate support lies to the left of the parallelogram linkage in the direction of travel. Without departing from the features of the invention, a position of the pivot shaft to the right of the parallelogram linkage is also possible. The inventive idea also covers a variation, which is that the pivoting means for the clamping board 40 is not arranged—as described—on that end of the intermediate suppport which is facing the fixing means, but on the opposite end, i.e. between the parallelogram linkage and the clamping board 40.

For purposes of description and illustration, it should be noted that the connection means as generally referred to herein in the various embodiments includes a pivot bearing rotatably joining first and second bearer sections together. One bearer section supports the pivot bearing from the fixing plate and the other bearing section supports the clamping plate from the pivot bearing.

I claim:

1. Intermediate support apparatus suitable for mounting an outboard motor on a transom of a boat, said support apparatus comprising:

fixing means for mounting said support apparatus on said transom, connection means secured to said fixing means and being spaced from said transom, said connection means carrying a clamping board to which the outboard motor can be clamped, said connection means further including at least one pivot bearing including a pivot axis disposed in a substantially vertical plane, and said connection means further including a first mounting or bearer section between said fixing means and said pivot bearing for mounting said pivot bearing on said fixing means, and a second mounting or bearer section disposed between said pivot axis and said clamping board for mounting said clamping board on said pivot bearing, all such that the distance between said clamping board and said pivot bearing is approximately equal to or greater than the distance between said pivot bearing and said fixing means, when measured along said mounting apparatus, said clamping board being movable about said axis between an operating position parallel to the transom and at least one lateral rest position, and latching means for selectively fixing the positions of said clamping board in each of these positions.

2. Intermediate support apparatus as in claim 1, wherein the connection means comprises at least one support or bearer divided by the pivot bearing into two bearer sections.

3. Intermediate support apparatus as in claim 2, wherein the pivot bearing comprises an internal tube fixed to the one bearer section and an external tube fixed to the second bearer section.

4. Intermediate support apparatus as in claims 2 or 3 wherein the clamping board is secured to a compensating stirrup means and said stirrup means is rotatably mounted, on a substantially horizontal axis, to a second bearer section, said stirrup means being selectively positioned about said horizontal axis for vertical alignment of a motor.

5. Intermediate support apparatus as in claim 4, wherein said clamping board has several horizontally staggered spare fixing holes, which holes serve for the attachment of the clamping board on the compensating stirrup, the attachment being selectively symmetrical and asymmetrical.

6. Intermediate support apparatus as in claim 1, 2 or 3 wherein said pivot bearing includes a fixed portion and a movable portion, and wherein said latching means includes a retractable spring biased locking bolt mounted to one of said portions and a lock element having a plurality of bolt receiving apertures connected to another of said portions, said apertures corresponding in position to said operating and rest positions, and said bolt being selectively spring biased into respective ones of said apertures for locking said clamping board in respective ones of said positions.

7. Intermediate support apparatus as in claim 1, wherein the connection means comprises bearer sections produced from square-section tubing.

8. Intermediate support apparatus as in claim 1, wherein said pivot bearing includes elements displaceable axially of one another so that the clamping board is adjustable in height.

9. Intermediate support apparatus as in claim 8 wherein the pivot bearing comprises an external tube and an internal tube longer than said external tube, wherein the external tube can be displaced axially by a lifting means relatively to the longer internal tube, can be secured in an upper end position by an arresting means and is restricted in its downward movement by a stop.

10. Intermediate support apparatus as in claim 9, including a lifting means having a cable means without a free cable end and being operatively attached between said external tube and a winch roller and crank.

11. Intermediate support apparatus as in claim 10, wherein said cable means is disposed substantially inside the internal tube.

12. Intermediate support apparatus as in claims 9, 10 or 11, the arresting means comprising a support lever which can be deflected manually relatively to the fixing plate and against the force of a spring.

13. Intermediate support apparatus as in claims 9, 10 or 11, wherein the pivot bearing comprises an internal tube having a vertical slot and an internal slot, and an external tube, and further including a guiding element fitted on the external tube, which element, on being lowered, is displaceable in said vertical slot of the internal tube and, in the upper end position of the clamping board, can be turned inside a horizontal slot of the internal tube, said horizontal slot being at the top of said internal tube and adjoining the vertical slot, and said vertical slot being disposed in said internal tube such that the plane which passes through the vertical slot and the axis of the internal tube extends approximately perpendicular to the fixing plate.

14. Intermediate support apparatus as in claim 13, wherein the lifting means acts on the guiding element.

15. Intermediate support apparatus as in claim 9, wherein the lifting means includes a tackle means having a free rope end, said end being guided out of said intermediate support.

16. Intermediate support apparatus as in claim 1, wherein said connecting means includes said pivot bearing and a parallelogram lifting linkage connected thereto, and said linkage being selectively lockable relative to the fixing means at least in the operating position and said clamping board is adjustable in height.

17. Intermediate support apparatus as in claim 16, wherein the pivot bearing is disposed laterally alongside the parallelogram linkage.

18. Intermediate support apparatus as in claims 16 or 17, wherein the axis of the pivot bearing lies between end points of the parallelogram linkage in the operating position of the intermediate support.

19. Intermediate support apparatus as in claim 1, wherein the pivot bearing comprises an internal tube and, bearings thereon which can at least be turned, the internal tube being disposed on the fixing means and the bearings being a constitutent of a clamping board bearer.

20. Intermediate support apparatus suitable for mounting an outboard motor on a transom of a boat, said support apparatus comprising:

fixing means for mounting said support apparatus on said transom, connection means secured to said fixing means and being spaced from said transom, said connection means carrying a clamping board to which the outboard motor can be clamped, said connection means further including at least one pivot bearing including a pivot axis disposed in a substantially vertical plane, said clamping board being movable about said axis between an operating position parallel to the transom and at least one lateral rest position, latching means for selectively fixing the positions of said clamping board in each of these positions, and said connection means further including apparatus operably disposed between said pivot axis and said clamping board for lifting said clamping board with respect to said fixing means.

21. Intermediate support apparatus suitable for mounting an outboard motor on a transom of a boat, said support apparatus comprising:

fixing means for mounting said support apparatus on said transom, connection means secured to said fixing means and being spaced from said transom, said connection means carrying a clamping board to which the outboard motor can be clamped, said connection means further including at least one pivot bearing including a pivot axis disposed in a substantially vertical plane, and between said fixing means and said clamping board, said clamping board being pivotable about said axis between an operating position parallel to the transom and at least one lateral rest position, and said connection means further including lifting apparatus, at least a portion of which is disposed outboard of said pivot axis, for lifting said clamping board with respect to said fixing means.

* * * * *